United States Patent [19]

Hileman, Jr.

[11] 4,019,284

[45] Apr. 26, 1977

[54] SELF-CONTAINED SANDBLASTING APPARATUS

[76] Inventor: Fred Lee Hileman, Jr., 7433 Columbia Road, Olmsted Falls, Ohio 44138

[22] Filed: July 7, 1975

[21] Appl. No.: 593,438

[52] U.S. Cl. ..... 51/9 M; 51/12

[51] Int. Cl.[2] ..... B24C 3/00

[58] Field of Search ..... 51/8, 9 M, 12, 258; 222/165, 166; 239/657

[56] References Cited

UNITED STATES PATENTS

| | | | |
|---|---|---|---|
| 1,864,612 | 6/1932 | Pearson et al. | 239/657 X |
| 3,075,319 | 1/1963 | Blubaugh | 51/9 M X |
| 3,399,492 | 9/1968 | Crowe et al. | 51/12 X |
| 3,432,969 | 3/1969 | Byttebier | 51/9 M X |
| 3,498,003 | 3/1970 | Hulbert, Jr. | 51/12 |
| 3,851,804 | 12/1974 | Fyrk | 239/657 X |
| R27,314 | 3/1972 | Codina et al. | 51/9 M |

*Primary Examiner*—Al Lawrence Smith
*Assistant Examiner*—James G. Smith
*Attorney, Agent, or Firm*—Fay & Sharpe

[57] ABSTRACT

Self-contained sandblasting apparatus includes a wheeled support and transport platform having a large generally rectangular sand receptacle mounted thereon and including outlet means adjacent one bottom end thereof for dispensing sand therefrom. Power means is connected between the platform and receptacle for tilting the receptacle to raise the other bottom end thereof higher than the one bottom end. Pneumatically operated sandblasting means includes a sand reservoir of substantially smaller size than the receptacle positioned for receiving sand from the receptacle outlet means. Air compressor means is mounted on the platform for supplying air to the sandblasting means.

6 Claims, 6 Drawing Figures

SELF-CONTAINED SANDBLASTING APPARATUS

BACKGROUND OF THE INVENTION

This application pertains to the art of sandblasting and, more particularly, to self-contained sandblasting apparatus of the type wherein a large sand supply receptacle, an air compressor and pneumatically operated sandblasting devices are all mounted on a common wheeled support and transport platform.

Large sandblasting projects, such as sandblasting large buildings or a plurality of storage tanks for petroleum products, frequently take many days or weeks to complete. Pneumatically operated sandblasting devices normally have sand reservoirs which do not hold more than around 2000 pounds of sand. Such reservoirs must be refilled rather frequently, and this requires extra labor and equipment, along with lost time.

Many arrangements have been proposed for arranging the various equipment required for sandblasting operations so that frequent replenishing of the sand is not required or is easily accomplished. U.S. Pat. No. 3,498,003 issued Mar. 3, 1970, to Hulbert discloses an arrangement wherein a sandblasting device, an air compressor and a sand supply receptacle are all separate from one another. This makes it difficult to transport the equipment to a work site and is further difficult to transport the equipment from one location to another at the work site. In addition, the sandblasting device must be of the type which requires a vacuum transfer of sand from the supply receptacle to the reservoir on the sandblasting device.

U.S. Pat. No. 3,399,492 issued Sept. 3, 1968, to Crowe, et al. discloses an arrangement wherein a sand supply receptacle and sandblasting devices are mounted on a wheeled support and transport platform. However, the air compressor is towed as a separate piece of equipment. In addition, the sand supply receptacle requires a sloping bottom in order to insure complete discharge of its contents into the reservoir on the sandblasting device. The use of a receptacle with a sloping bottom greatly reduces the capacity of the receptacle, and a great deal of space is wasted. The sandblasting devices in Crowe also are rather permanently mounted to the platform so that replacement and repair, or adjustment, would be rather difficult. A pneumatic transfer conveyor is also required for transferring sand to the relatively small sand receptacle from a tank car.

U.S. Pat. Nos. 3,075,319 issued Jan. 29, 1963, to Blubaugh and 3,559,343 issued Feb. 2, 1971, to Foster disclose apparatus wherein a sand supply receptacle, an air compressor and sandblasting devices are all mounted on a common support and transport platform. The Blubaugh apparatus has a sand supply receptacle with a steeply sloping bottom and this wastes a large amount of space on the apparatus. In order to obtain a large capacity in the sand supply receptacle, the receptacle would have to be extremely high. In addition, the sandblasting devices are mounted forwardly of the sand supply receptacle in a relatively inaccessible and permanent manner so that replacement and repair thereof would be somewhat difficult. Furthermore, there is no provision in Blubaugh for raising the sandblasting devices for road clearance during transport, with the only adjustment being for the outlet nozzles. The Foster apparatus includes a relatively small sand supply bin in the embodiment of FIGS. 6 and 7, and a workman must frequently replenish such bin by emptying bags of sand into the same. The pneumatically operated sandblasting device is positioned on the support and transport platform itself so it would not be possible to conveniently replenish a sand reservoir on the sandblasting device by gravity flow from a large receptacle mounted on the platform.

SUMMARY OF THE INVENTION

Self-contained sandblasting apparatus includes a wheeled support and transport platform having a large generally rectangular sand receptacle mounted thereon and including outlet means adjacent one bottom end thereof for dispensing sand therefrom. Power means connected between the platform and receptacle is provided for tilting the receptacle to raise the other bottom end thereof higher than the one bottom end. Pneumatically operated sandblasting means having a sand reservoir is positioned for discharge of sand through the outlet means into the reservoir. Air compressor means is mounted on the platform for supplying air to the pneumatically operated sandblasting means.

In a preferred arrangement, the support and transport platform is substantially elevated above a supporting surface for the wheels and includes a rear platform end. The outlet means on the sand receptacle is located adjacent the rear platform end, and carrier means is mounted on the platform adjacent the rear platform end for carrying the sandblasting means.

In accordance with another aspect of the present application, the carrier means for the sandblasting means is mounted for raising and lowering movement relative to the platform. The carrier means is raised to an elevated position during transport of the platform and the apparatus mounted thereon, and is lowered to a working position when the sand receptacle is tilted for supplying sand to the reservoir on the sandblasting means.

Although the sandblasting means may be of the closed top-type, a preferred arrangement uses sandblasting means of the type having a top funnel, with conduit outlet means on the receptacle outlet means being located within the funnel below the funnel upper edge so that sand building up in the funnel above the conduit outlet means automatically controls the flow of sand from the receptacle.

The apparatus of the present invention preferably includes a sand receptacle having a plurality of spaced-apart outlets, and a separate sandblasting device mounted adjacent each outlet so that a plurality of workmen can independently use sandblasting devices which are all supplied with sand from the large sand receptacle.

A surge tank is preferably mounted on the platform, and connected between the air compressor reservoir and the sandblasting devices for serving as a moisture trap and also insuring sufficient air capacity for supplying all of the sandblasting devices.

Power means for tilting the sand receptacle may take many forms, and in one arrangement comprises a fluid cylinder which may be pneumatically operated by the air compressor, or may be hydraulically operated by a hydraulic pump on the vehicle used to transport the platform, or by a hydraulic pump driven by an air motor operated off the air compressor.

The carrier means at the rear of the platform may be raised and lowered by any suitable means, including fluid operated cylinders or manually operated mechanical mechanisms such as ratchet and pawl devices, or screw jack-type devices.

Frame means is provided on the platform for storing hundreds of feet of air hose.

It is a principal object of the present invention to provide an improved self-contained sandblasting apparatus which is easily transported from one location to another, and carries sufficient sand for many days of work with a plurality of pneumatically operated sandblasting devices.

It is a further object of the invention to provide a self-contained sandblasting apparatus wherein the pneumatically operated sandblasting devices are conveniently mounted on a support platform for easy replacement or repair.

It is an additional object of the invention to provide a self-contained sandblasting apparatus wherein a sand supply receptacle is of generally rectangular shape for holding a large quantity of sand and is tiltable for gravity flow of sand therefrom into the sandblasting devices.

It is also an object of the invention to mount sandblasting devices on a self-contained sandblasting apparatus for raising and lowering movement so that road clearance may be provided for transportation, while a lower elevation is provided in the working position.

BRIEF DESCRIPTION OF THE DRAWINGS

FIG. 3 is a fragmentary side elevational view showing the rear of a sand supply receptacle and a sandblasting device;

DESCRIPTION OF A PREFERRED EMBODIMENT

Figure 1:
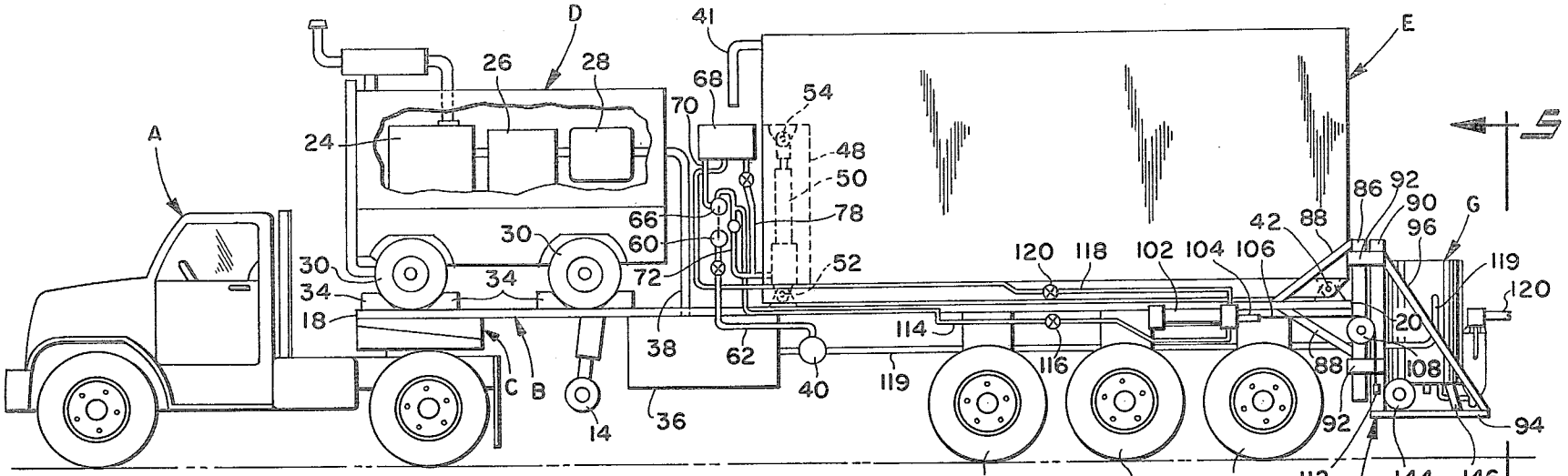
FIG. 1 is a side elevational view of a sandblasting apparatus constructed in accordance with the present invention.

With reference to the drawings, FIG. 1 shows a conventional tractor A driven by an internal combustion engine and releasably coupled to a flatbed trailer B by a fifth wheel C. Flatbed trailer B includes wheels 12, and lowerable dollies 14 for supporting trailer B in a generally horizontal position when tractor A is uncoupled therefrom. It will be recognized that the improved arrangement of the present application can also be used with a large vehicle wherein the tractor A is permanently connected with the trailer B.

The trailer B defines a generally flat rectangular wheeled support and transport platform. Platform B has a front end 18 and a rear end 20, and air compressor means D is mounted on platform B adjacent front end 18 thereof. Air compressor D includes an internal combustion engine 24 driving an air compressor 26 which supplies air to a reservoir 28. In the arrangement shown, air compressor D is of the wheeled type and includes wheels 30 supported on platform B, and fixed against movement as by wheel chocks 34. Suitable other securing means, such as chains or the like, can be passed over the axles of wheels 30 and secured to platform B if so desired for removably securing air compressor D to platform B.

A surge tank 36 is suitably mounted beneath platform B, and is connected with air compressor 28 by conduit 38. Obviously, suitable check valves are located in the various conduits for preventing back flow of air. Surge tank 36 serves as a moisture trap and also has a larger capacity than reservoir 28 so that a sufficient supply of pressurized air will be available to sandblasting devices connected with surge tank 36. Surge tank 36 has a manifold 40 for connecting a plurality of air hoses thereto.

A very large generally rectangular receptacle E is mounted on platform B between rear end 20 thereof and air compressor D. Receptacle E has a capacity for holding an entire tank car of sand, and this may be a capacity of 40 tons. Of course, a slightly larger or smaller capacity receptacle could be used as deemed necessary or desirable. A fill pipe 41 is provided for receptacle E for filling same with a pneumatic sand conveyor in a known manner. Obviously, other arrangements may be provided for refilling receptacle E, including top openings.

A plurality of transversely spaced-apart brackets and pin assemblies 42 pivotally connect receptacle E adjacent the bottom rear end thereof to platform B adjacent rear end 20 thereof. The front end portion of receptacle E has a generally rectangular cavity 48 therein which opens downwardly and receives a telescoping fluid cylinder 50 pivotally connected at its bottom end with platform B by suitable bracket and pin assembly 52 and at its top end with the top wall of recess 48 by another bracket and pin assembly 54.

The power means defined by fluid cylinder 50 for tilting receptacle E may be pneumatic cylinder connected by a conduit with surge tank 36, or may be a hydraulic cylinder supplied with hydraulic fluid from a pump driven by the engine of tractor A or the engine of air compressor D. In one arrangement, as shown in FIG. 6, an air motor 60 is supplied with air through a conduit 62 having a valve 64 and being connected with manifold 40. Air motor 60 is drivingly connected with a hydraulic pump 66 supplied with hydraulic fluid from a reservoir 68 through conduit 70. Conduit 72 having a valve 74 connects hydraulic pump 66 with the bottom end of cylinder 50. An exhaust conduit 78 also connected with the bottom of cylinder 50 to reservoir 68 has a manually operated valve 80 for lowering cylinder 50. When it is desired to tilt receptacle E, valves 64 and 74 are opened to operate air motor 60 which drives hydraulic pump 66 for supplying hydraulic fluid to cylinder 50 and extending same. When receptacle E has been tilted to its desired position, valves 64 and 74 may be closed. When it is desired to lower receptacle E back to its horizontal position, manually operated valve 80 is opened so that the weight of receptacle E causes retracting movement of cylinder 50, and the fluid therein flows back into reservoir 68.

Carrier means F is mounted adjacent rear end 20 of platform D for carrying pneumatically operated sandblasting means G of a conventional type which conveys sand or other abrasive grit against a surface to be sandblasted. Elongated vertical braces 86 are secured to opposite sides of platform B adjacent rear end 20 thereof, and are braced by inclined braces 88 suitably connected thereto and to platform B. Carrier means F is generally L-shaped in side view and includes vertical portions 90 having generally U-shaped straps 92 secured thereto in vertically spaced-apart relationship, and slidably received around vertical braces 86. Generally horizontal carrier support portion 94 is secured to vertical portion 90 and braced by inclined braces 96.

Figures 2, 4, 5:
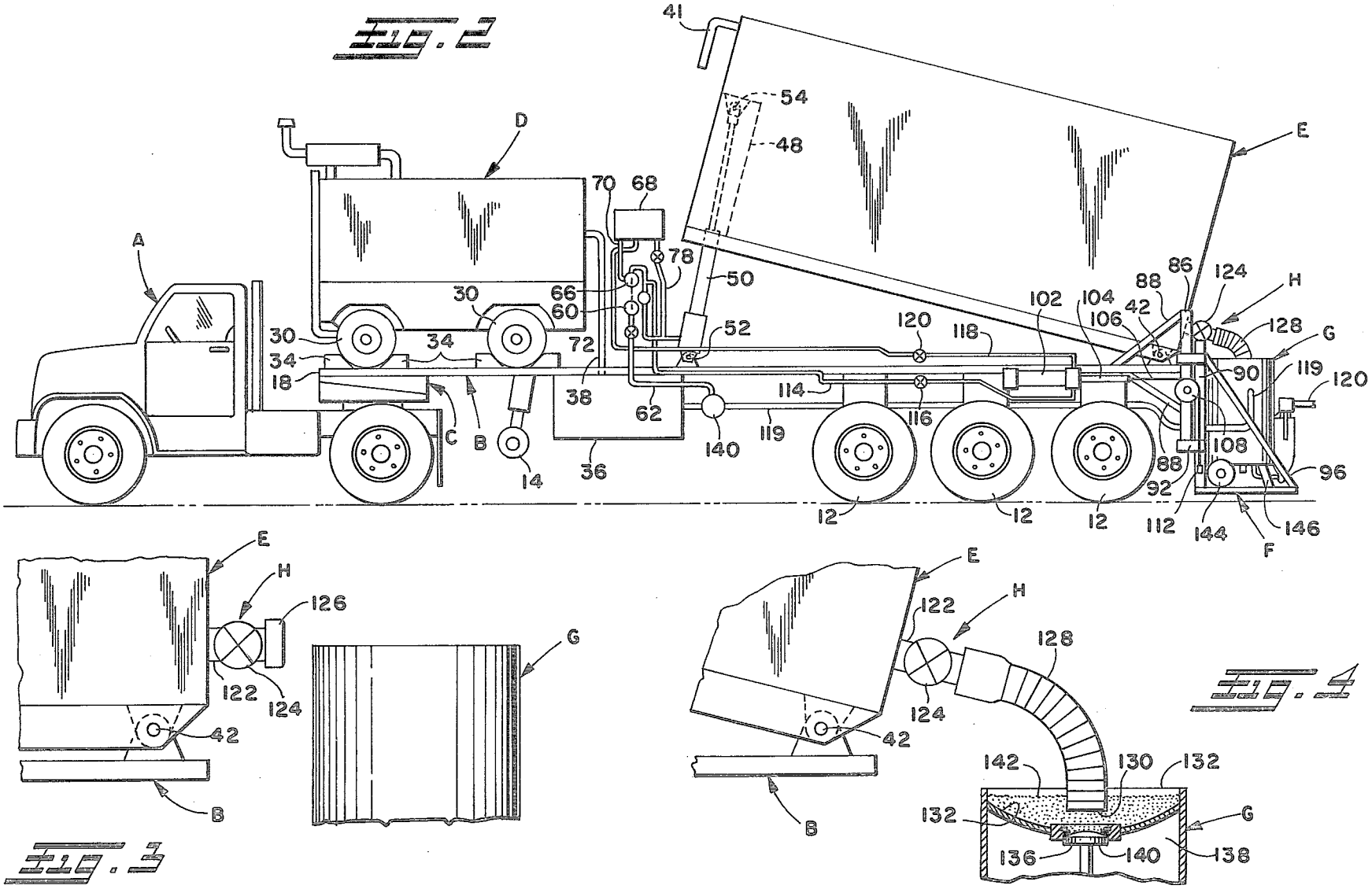
FIG. 2 is a view similar to FIG. 1 and showing the sand receptacle in a tilted position, and the pneumatically operated sandblasting means in a lower working position.
FIG. 4 is a view similar to FIG. 3 showing the sand supply receptacle in a tilted position, and with an outlet conduit positioned within a funnel on a reservoir of a sandblasting device.
Figure 5:
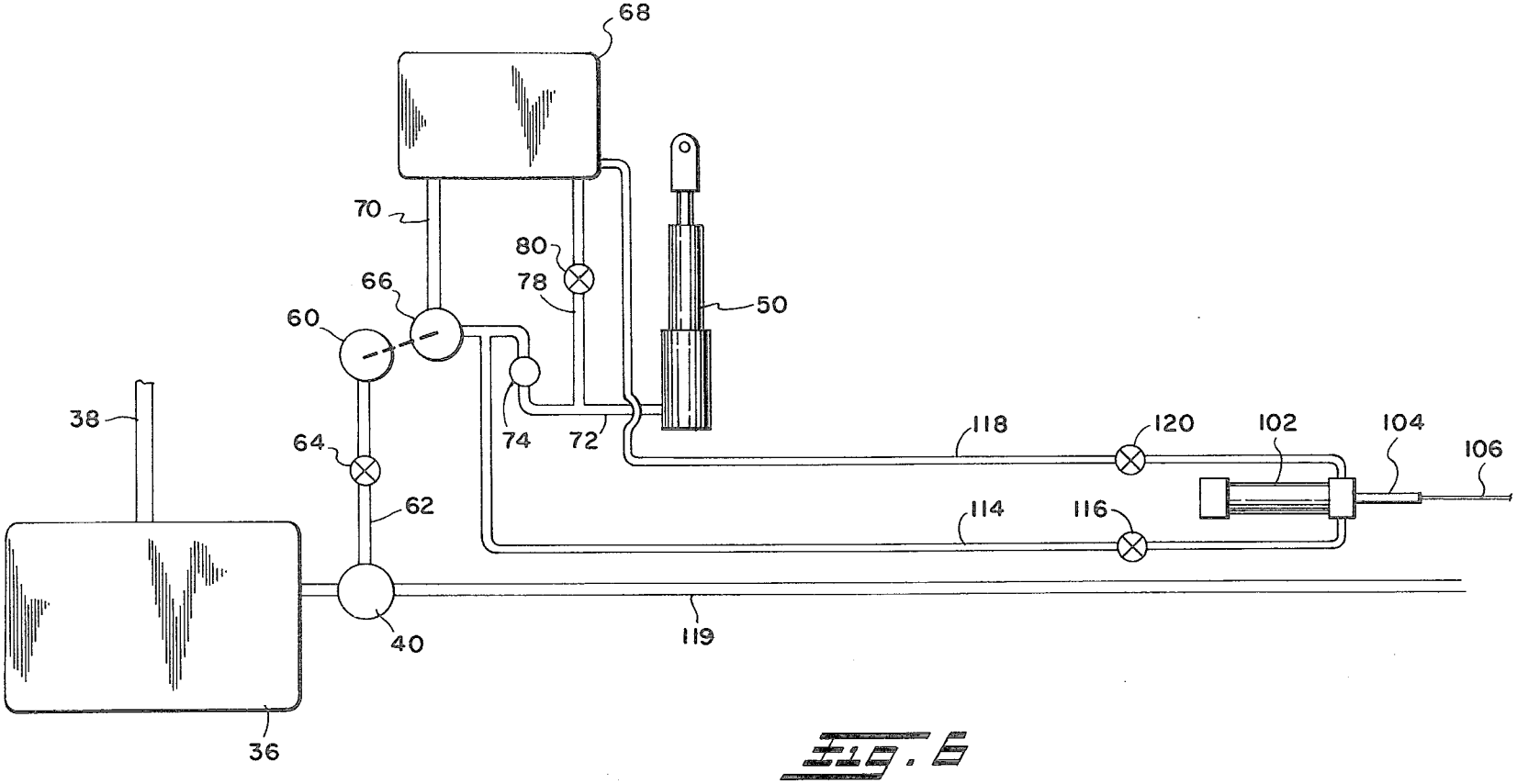

Any suitable means may be provided for raising and lowering carrier means F. In one arrangement, as shown in FIGS. 1, 2 and 6, a hydraulic cylinder 102 on each side of platform B has its rod 104 connected with a cable 106 extending around a pulley 108 rotatably mounted on vertical braces 86 and connected with vertical portions 90 of carrier F as at 112. Cylinder 102 is connected with pump 66 by conduit 114 having a valve 116. A conduit 118 having valve 120 connects cylinder 102 with reservoir 68. Opening of valve 116 when hydraulic pump 66 is operating will retract cylinder rod 104 to vertically raise carrier means F. Closing of valve 116 will maintain cylinder rod 104 retracted with carrier means F in its elevated position. Opening valve 120 will bleed hydraulic fluid from cylinder 102 back to reservoir 68 for allowing extension of rod 104 to lower carrier means F to a lower position. Suitable vertically spaced holes may be provided in braces 86 for receiving pins to act against straps 92 for holding carrier means F in its elevated or lowered positions.

In one arrangement, the elevated position of carrier means F has horizontal support portion 94 thereof elevated approximately 17 inches above the road surface on which wheels 12 are supported. In the lowered position of carrier means F, horizontal support portion 94 thereof is elevated approximately 4 inches above the road surface. This advantageous arrangement makes it possible to move the support platform at a work site without danger of breaking any air hoses or damaging sandblasting means G. Instead of using hydraulic cylinders for raising and lowering carrier means F, it is obvious that many other arrangements including pneumatic cylinders can be used. In addition, it is possible to use power means in the form of manually powered devices such as a pawl and ratchet mechanism, or a scissors jack mechanism, or worm gears on a rotatable shaft having a manually operated crank for rotating the worm gears to cooperate with worm wheels on vertical screw shafts for raising and lowering carrier means F.

Pneumatically operated sandblasting means G may take many forms and in one arrangement may comprise a sandblasting device marketed under the trademark "Sanstrom" as shown in Sanstorm catalogue No. 549-2. Sandblasting means G is connected by air hose 119 with manifold 40 of surge tank 36. Air hose 120 connected with sandblasting means G has a suitable nozzle in a known manner handled by a workman for projecting sand particles at high velocity against a surface to be sandblasted. Sandblasting means G is preferably of the remote control type wherein a control at the nozzle handled by the workman can be operated for operating a blowoff valve which closes the supply of air through hose 119 to the sandblasting means G and depressurizes sandblasting means G so its sand reservoir can be refilled. Obviously, many other types of sandblasting means G can also be used if so desired, including the simple aspirating type.

In one arrangement, the outlet means H for receptacle E may simply comprise an outlet pipe shown generally at 122 in FIG. 2 having a suitable manually operated valve 124 for selectively opening and closing the outlet. A cap member 126 may be threaded onto pipe 122 for normally closing same during transport of platform B. In the elevated position of carrier means F shown in FIGS. 1 and 3, carrier means F and sandblasting means G can pass outlet means H. The outlets for receptacle E can be located in different locations, but are preferably located adjacent the bottom rear end thereof as shown in FIG. 3. The outlets can extend outwardly from the bottom of receptacle E adjacent the rear wall thereof, and in the arrangement shown are extending through the rear wall thereof directly adjacent the bottom wall thereof.

When it is desired to use the apparatus, cap member 126 is removed from pipe 122, and an outlet conduit 128 secured thereto as by threading. Conduit 128 may simply comprise a generally L-shaped conduit, or may be a flexible metal conduit made of spirally wrapped metal so that it will hold its bent position after manual manipulation. Receptacle E is then tilted for raising the other bottom end thereof opposite from the bottom end adjacent which the outlet means H is located. Receptacle E is preferably tiltable to the general position of FIG. 2 by operation of power means 50 to an inclination which is greater than the angle of repose of the sand or other abrasive material contained within receptacle A. As shown in FIG. 4, conduit 128 has an outlet 130 located below upper edge 132 of sandblast device G which also has a downwardly inclined upper wall 134 with a centrally located inlet opening 136 defining inlet means to sand reservoir 138 which may be closed by a pneumatically operated valve 140 when the reservoir is charged with sand and air pressure. Upper wall 134 and upper edge 132 cooperate to define a funnel, and conduit outlet 130 is located within such funnel below upper edge 132 thereof. Sand flowing through conduit 128 when valve 124 is open will build up to a level as shown generally at 142 above outlet 130 to automatically cut off flow of sand from receptacle E. When sandblasting means G is replenished with sand, operation of a control valve lowers valve member 140 so that sand flows from the funnel through opening 136, and the sand will not rise above the level generally shown at 142. Operation of the control valve will again close valve 140 to seal opening 136 so that sandblasting means G is again pressurized for operation.

Sandblasting means G as shown in FIG. 1 is of the wheeled-type having wheels as at 144 so that it can be transported. Such sandblasting means also has a plurality of circumferentially-spaced legs 146 which may be releasably bolted to horizontal support portion 94 of carrier means F. Sandblasting means G also normally has lifting eyes or brackets welded thereto and such eyes or brackets can be releasably strapped to carrier means F. This makes sandblasting means G easily removable for replacement or repair, or for use on other jobs when the entire apparatus is not required. Sandblasting means G is also in an easily accessible location adjacent the rear end of platform B for adjustment or repair.

Instead of being of the open type as shown in FIG. 3, sandblasting means G can also be of the closed type if so desired for preventing moisture from entering the sand reservoir during inclimate weather. In addition, it is possible to provide a canvas shroud or the like secured between receptacle E and covering the upper portions of sandblasting means G. Conventional covers are provided for sandblasting means G when conduits 128 are not received in the upper portions thereof.

Removability of outlet conduit 128 of FIG. 3 in effect makes it adjustable so that it is positioned above sandblasting means G in the tilted dispensing position of receptacle E, and is spaced outwardly away from above sandblasting means G in the elevated position of carrier means F. Although this adjustability is accomplished by removability of conduit 128 in the specific arrangement shown and described, it will be recognized that pivoted conduits can be provided to pivot laterally or vertically out of the way of sandblasting means G when carrier means F is raised to its elevated transport position.

With the arrangement shown and described, it is very easy to remove air compressor D from platform B along with sandblasting means G so that these components can be used on other jobs which do not require an extremely large supply receptacle E. When reference is made to sand, it will be recognized that this is intended to cover any type of abrasive grit, including steel grit.

When it is stated that the power means defined by cylinder 50 is powered by air compressor means D, it will be recognized that this is intended to cover the arrangement specifically shown in FIG. 6 wherein an air motor operated a hydraulic pump, as well as arrangements where cylinder 50 is a pneumatic cylinder, or where the hydraulic pump is driven by the engine of air compressor means D.

Various hose storage frames are preferably provided on platform B for storing the air hoses extending from sandblasting means G to the nozzles handled by the workmen. Such frames may be provided beneath platform B, as well as on the sides thereof, or between compressor means D and receptacle E.

Figure 5:
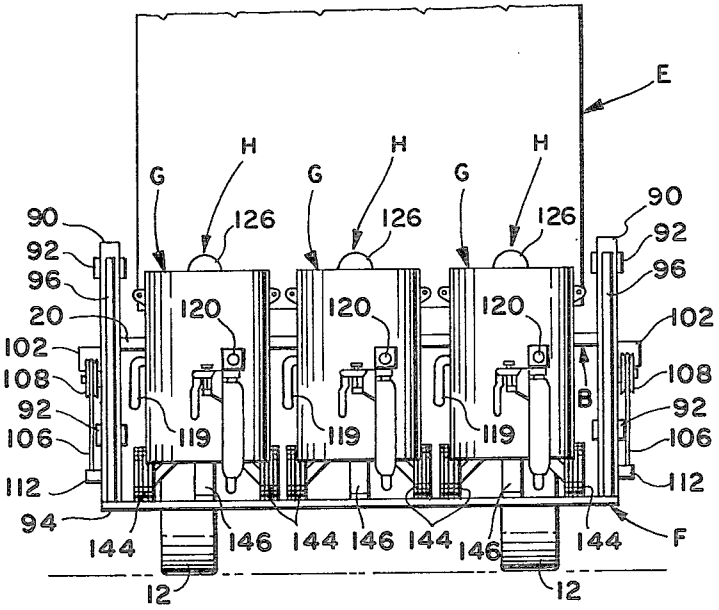
FIG. 5 is a rear elevational view looking generally along line 5—5 of FIG. 1; and, FIG. 6 is a simplified schematic illustration of a pneumatic and hydraulic circuit.

As shown in FIG. 5, three outlet means H are provided on receptacle E, and one sandblasting means G is mounted on carrier means F adjacent each outlet means H.

In a preferred arrangement, receptacle E has a capacity which is at least around 130 times the capacity of the sand reservoir on one pneumatically operated sandblasting device G.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

Having thus described my invention, I now claim:

1. Self-contained sandblasting apparatus comprising: an elevated wheeled support and transport platform having releasable coupling means for releasably coupling said platform to a powered towing vehicle for transporting said platform from one location to another, said platform including front and rear platform ends, a large generally rectangular substantially closed sand receptacle mounted on said platform and having outlet means adjacent one bottom end thereof for dispensing sand therefrom, said outlet means being located adjacent said rear platform end, receptacle power means for tilting said receptacle to raise the other bottom end thereof higher than said one bottom end, pneumatically operated sandblasting means for projecting sand particles against a surface to be sandblasted and including a sand reservoir of substantially smaller size than said receptacle and having reservoir inlet means for filling said reservoir with sand, said sandblasting means being positioned for flow of sand from said outlet means to said inlet means, said sandblasting means reservoir being connected by elongated flexible conduit means with manipulatable nozzle means for manipulation by a workman remote from said platform, carrier means mounted on said platform adjacent said rear platform end for raising and lowering movement relative to said platform, said carrier means including generally horizontal carrier support means spaced a substantial distance downwardly from said platform, said sandblasting means including said reservoir being releasably secured to and supported on said carrier support means in upstanding relationship thereto, and a wheeled self-contained engine driven air compressor means removably mounted on said platform remote from said sandblasting means between said receptacle and said platform front end for supplying air to said sandblasting means.

2. The apparatus of claim 1 wherein said outlet means comprises a plurality of spaced-apart outlets, and said sandblasting means comprises a plurality of sandblasting devices, one of said sandblasting devices being mounted adjacent each said outlet.

3. The apparatus of claim 1 wherein said receptacle power means for tilting said receptacle comprises fluid cylinder means powered by said air compressor means.

4. The apparatus of claim 1 including power means for selectively raising and lowering said carrier means.

5. The apparatus of claim 1 wherein said carrier means is generally L-shaped in a side view and includes a generally horizontal portion defining said generally horizontal carrier support means and generally vertical portions secured to said platform for vertical movement relative thereto.

6. The apparatus of claim 1 wherein said carrier means is movable between elevated and lowered positions and said generally horizontal carrier support means in said lowered position of said carrier means being elevated above the surface on which said platform is supported.

* * * * *